US006091829A

United States Patent [19]

Blackmer et al.

[11] Patent Number: 6,091,829

[45] Date of Patent: Jul. 18, 2000

[54] MICROPHONE APPARATUS

[75] Inventors: David E. Blackmer; Aleksey S. Khenkin, both of Wilton, N.H.

[73] Assignee: Earthworks, Inc., Milford, N.H.

[21] Appl. No.: 09/023,748

[22] Filed: Jan. 23, 1998

[51] Int. Cl.[7] ..... H04R 25/00

[52] U.S. Cl. ..... 381/356; 381/355; 381/345; 381/360

[58] Field of Search ..... 381/356, 357, 381/176, 358, 345, 346, 348, 355, 360

[56] References Cited

U.S. PATENT DOCUMENTS

| | | | |
|---|---|---|---|
| 2,566,094 | 8/1951 | Olson | 381/355 |
| 2,870,856 | 5/1959 | Olson | 381/355 |
| 4,528,426 | 7/1985 | Fatovic et al. | 179/121 |
| 4,694,499 | 9/1987 | Bartlett | 381/155 |
| 5,193,117 | 3/1993 | Ono et al. | 381/71 |
| 5,226,087 | 7/1993 | Ono et al. | 381/92 |
| 5,282,245 | 1/1994 | Anderson | 379/433 |

FOREIGN PATENT DOCUMENTS 536066 10/1939 United Kingdom .

OTHER PUBLICATIONS

"A Self–Contained Condeser Microphone With Improved Transient Response" Dauger et al Journal of the Audio Engineerign Society; 1968; pp. 148–151.

"New High–Grade Condenser Microphones" Bauch Journal of the Audio Engineering Society; 1953; pp. 79–80.

*Primary Examiner*—Curtis A. Kuntz
*Assistant Examiner*—Dionne N. Harvey
*Attorney, Agent, or Firm*—Hayes, Soloway, Hennessey, Grossman & Hage, P.C.

[57] ABSTRACT

A microphone housing system is disclosed having a tapered structure enclosed within the housing structure coupled to a rear portion of a microphone element. In the preferred embodiment, the tapered portion has a generally conic shape expanding away from the rear portion of the microphone element. The housing structure surrounding the tapered structure has a plurality of radially disposed opening or slots and fully or partially covered with a sound-resistive material. The housing system provides increased front-to-back signal ratio and increased overall gain and frequency response due to superior rear signal cancellation.

12 Claims, 5 Drawing Sheets

MICROPHONE APPARATUS

BACKGROUND OF THE INVENTION

1. Field of the Invention

The present invention relates to a microphone apparatus. More particularly, the present invention relates to a housing and mounting system for a directional microphone that eliminates extraneous reflecting surfaces, increases the front-to-back signal strength and improves the overall gain and frequency response of the microphone.

2. Description of Related Art

In 1933, J. Weinberger, H. F. Olson and F. Massa, J. Acoust. Soc. Amer., 5,139 (1933), it was shown how to combine two microphones with omnidirectional and figure-of-eight directivity characteristic into single sound receiver with a polar diagram of cardioid shape. The ideal cardioid characteristics is shown in the polar plot of FIG. 1. In 1935, von Braunmuhl and Weber, *Hochfrequenztechnik u. Elektroakustik,* 46, 187–192 (1935), described methods designed to modify the hitherto purely pressure type condenser microphone into a pressure-gradient type with cardioid directional characteristic. The microphone built as shown in FIG. 2 is sensitive to pressure gradient, has figure-of-eight directivity characteristic. The structure of the microphone shown in FIG. 2 has a single diaphragm 1 adjacent to an electrode 2. Alternatively, the microphone structure of FIG. 2 can be provided by fixing two equal diaphragms, 3 and 4, to both sides of the perforated fixed middle electrode 5, as shown in FIG. 3.

In an effort to achieve smooth frequency response, fast impulse response, and good front-to-back ratio further developments in microphone technology were made. A. Dauger and C. F. Swisher, A Self-contained Condenser Microphone with Improved Transient Response, Presented Apr. 29, 1968 at $34^{th}$ Convention of AES, Los-Angeles, described a single-diaphragm microphone element design utilizing elaborate acoustically resistive delay path behind of the back electrode. FIG. 4 depicts such a microphone structure having a single diaphragm 6, an electrode 7 and resistive delay path material 8.

The operative characteristics of the microphone of FIG. 4 is illustrated in FIG. 5. As shown in the first half of FIG. 5, consider a sound wave coming from the front direction. The wave can be though of as splitting into two parts upon reaching the microphone. Part A reaches the diaphragm 6 directly, and pushes downward on it. Part B goes around to the back and reaches the surface of the acoustical resistive delay network 8 at some time later than Part A reached the diaphragm surface 6. Part B then passes through the network 8, which causes the wave to arrive at the bottom of the diaphragm 6 pushing up on it at a later time than when part A pushed down on it. As a result there is considerable phase difference and hence pressure difference on the diaphragm 6. The diaphragm 6 moves and a signal is generated.

Consider now waves coming from the back, depicted in the second half of FIG. 5. When part A reaches the surface of the delay path 8, part B starts to go around to the front. Part B reaches the front of the diaphragm 6 and pushes down on it some time later. Meanwhile Part A is moving through the delay path 8. If the parameters of the path are chosen properly, Part A reaches the back side of the diaphragm 6 and pushes up on it at the same time part B is pushing down. The diaphragm 6 does not move and no signal results.

Of course, parameters of the delay 8 must be chosen very carefully to provide adequate phase shift for all audio band frequencies. Unavoidable problems also arise at very high frequencies where wavelengths become comparable to microphone element dimensions, which leads to additional phase shift, thereby decreasing the front-to-back ratio. In order to cope with this, the size of the microphone element is made as small as practicable.

In most conventional cardioid microphones the space around and behind the microphone element gets little or no careful acoustical design consideration. The microphone element is usually mounted some distance from the body and has a huge cage-like structure around it, as shown in FIG. 6. Disadvantageously, as a result of the inattention to the details of the housing structure, a large number of reflections (e.g., A' and B') result in such a structure as FIG. 6. These reflections have different arrival times, which causes the phase pattern to be smeared. These reflections lead to peaks and notches on the frequency response, as shown in FIG. 10, which are very audible as sound coloration, and deterioration of front-to-back ratio. FIG. 10 depicts a 0° incident frequency response, a 90° incident frequency response and a 180° incident frequency response, where the incident response is with respect to an axis taken perpendicular to a diaphragm of the prior art directional microphones. The peaks and notches shown in FIG. 10 are largely due to rear signal reflections within the housing structure, which degrades the front-to-back signal strength as well as degrading the overall gain of the microphone. What is worse, these sharp peaks and notches on the off-axis frequency response result in positive acoustic feedback when used in sound reinforcement applications.

In another approach in the prior art to provide a directional microphone structure, Bartlett (U.S. Pat. No. 4,694,499) discloses a directional microphone having an acoustic damping washer positioned adjacent the microphone rear entry. The washer is generally a doughnut-shaped element formed of sound absorbing material and positioned around the rear sound entry port of a directional microphone. The washer is so positioned in an effort to reduce reflections of front-arriving sound and absorb and cancel high-frequency sound which approach the rear of the transducer (microphone). However, Bartlett fails to consider the housing structure around the rear of the microphone, which can lead to extraneous reflecting waves and thus, a degradation of the overall frequency response, as described above. Moreover, Bartlett fails to consider the cumulative affect of the reflected signals within the housing structure that cannot be entirely canceled, thus decreasing the front-to-back signal strength.

Unfortunately, none of the aforesaid directional microphone systems disclose a structure that eliminates extraneous reflecting surfaces within the housing structure, increases the front-to-back signal strength and improves the overall gain (e.g., low frequency response) of the microphone. This is largely due to the failure in the prior art to provide an effective system that cancels virtually all rear signals, thereby approaching ideal cardioid response characteristics.

SUMMARY OF THE INVENTION

Accordingly, it is a primary object of the present invention to provide a directional microphone having a large front-to-back signal ratio. Another object of the present invention is to provide a directional microphone that virtually eliminates extraneous reflecting surfaces near the rear portion of the microphone element. Still another object of the present invention is to increase the overall gain and frequency response of a directional microphone.

These and other objects of the present invention are achieved by providing a directional microphone housing and structure that approaches ideal cardioid characteristics. To this end, the present invention provides a housing and structure that produces a moderately directional rear port system to improve the front frequency response and provides superior rear signal cancellation. Included in the preferred embodiment is a housing structure substantially surrounding a microphone element. Within this housing structure and coupled to a rear portion of the microphone element is a tapered structure reflecting and/or absorbing unwanted sound signals away from the rear portion of said microphone element. In the preferred embodiment, the housing structure at the rear of the microphone element has a plurality of radially disposed slots or openings and is fully or partially covered by a sound transparent material to permit reflecting signals near the rear portion of the microphone element to be reflected outward from the housing structure. Also in the preferred embodiment, the tapered structure is conically shaped expanding away from the rear portion of the microphone element. The generally conic shape provides gradually increasing acoustical impedance, due to the decrease in surface area. This increased impedance absorbs sounds thereby preventing sound from reaching the rear portion of the microphone element.

It will be appreciated by those skilled in the art that although the following Detailed Description will proceed with reference being made to preferred embodiments and methods of use, the present invention is not intended to be limited to these preferred embodiments and methods of use. Rather, the present invention is of broad scope and is intended to be limited as only set forth in the accompanying claims.

Other features and advantages of the present invention will become apparent as the following Detailed Description proceeds, and upon reference to the Drawings, wherein like numerals depict like parts, and wherein:

DETAILED DESCRIPTION OF PREFERRED EMBODIMENTS

Figure 1:
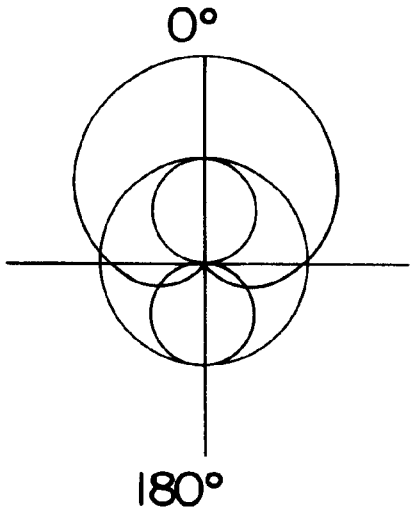
FIG. 1 is a polar-plot diagram of ideal cardioid frequency response characteristics of a directional microphone.
Figure 2:
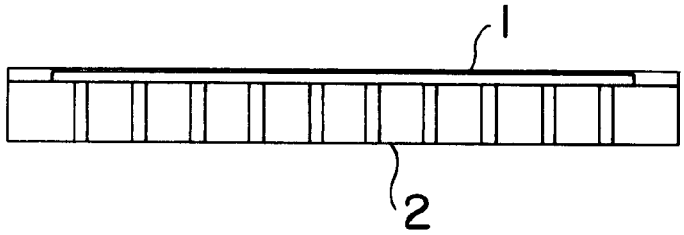
FIG. 2 depicts a microphone structure of the prior art.
Figure 3:
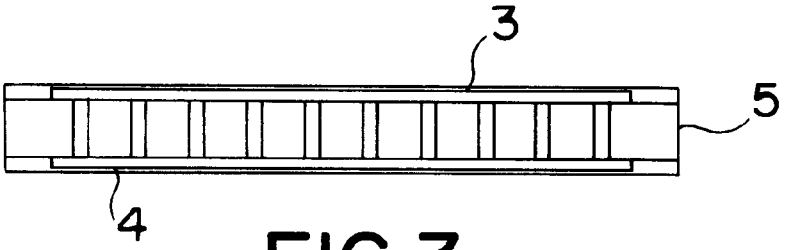
FIG. 3 depicts another microphone structure of the prior art.
Figure 4:
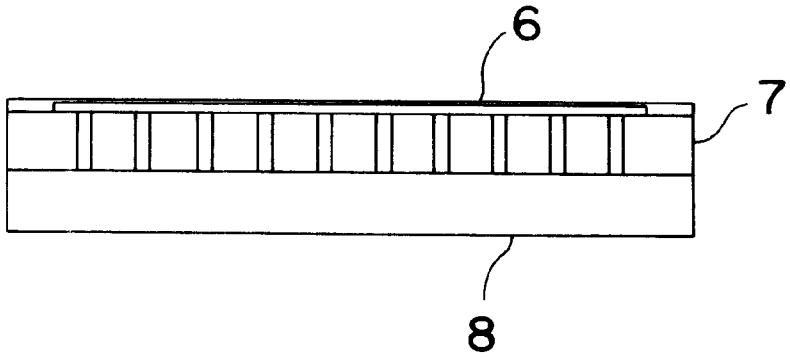
FIG. 4 depicts another microphone structure of the prior art.
Figure 5:
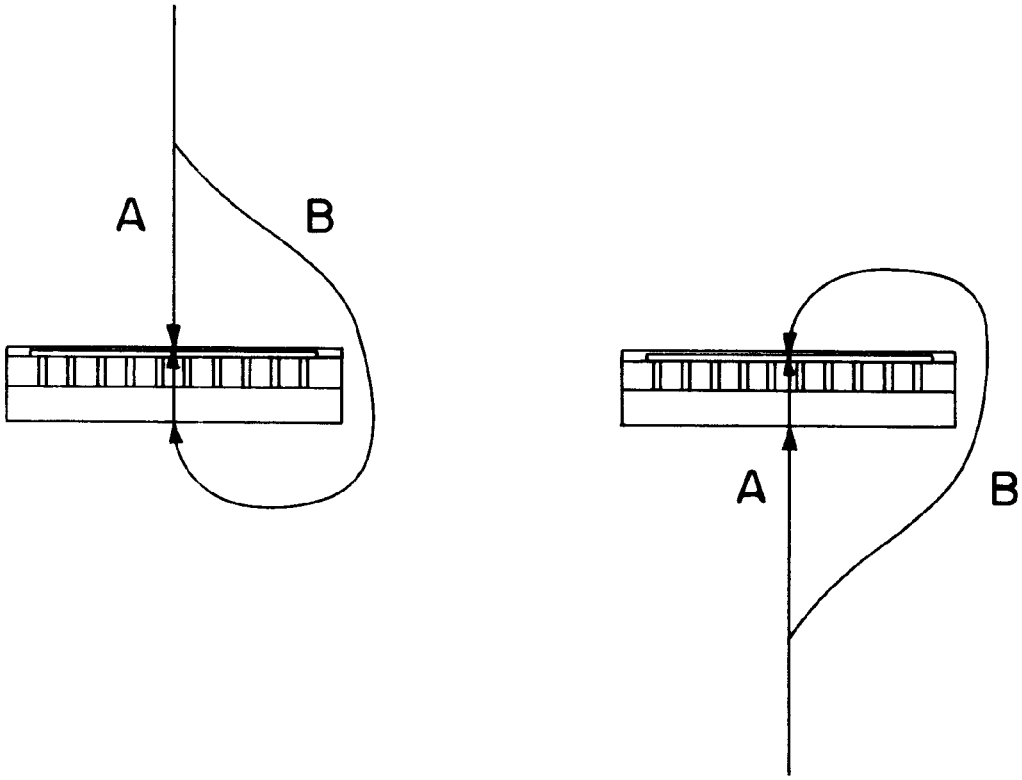
FIG. 5 depicts two examples of sound propagation in the microphone structure of FIG. 4.
Figure 6:
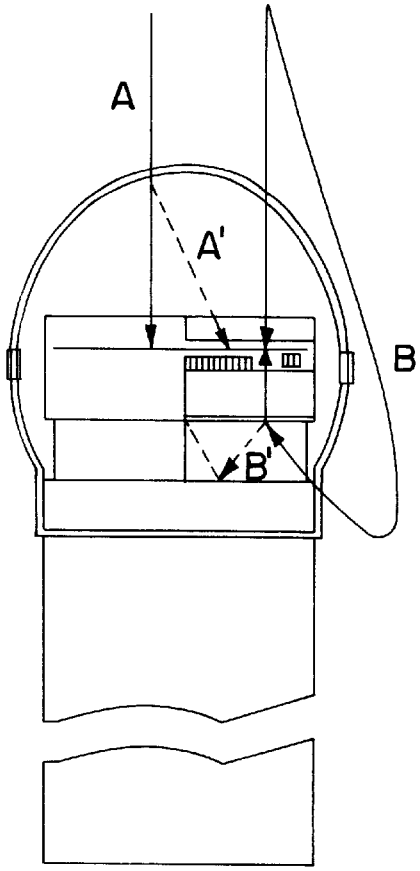
FIG. 6 depicts sound propagation through the microphone housing structure of the prior art.
Figure 7:
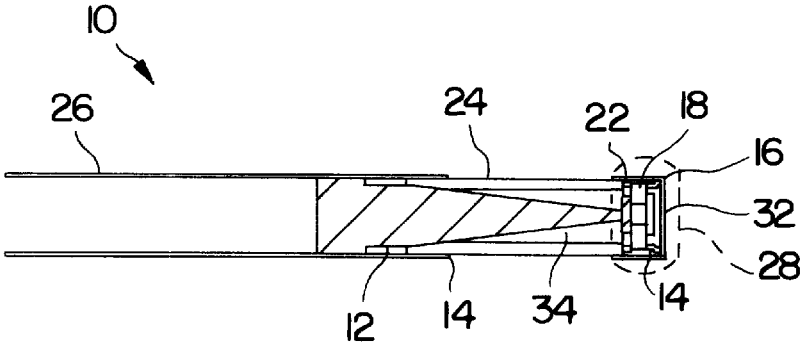
FIG. 7 is a cross-sectional view of the microphone housing and structure of the preferred embodiment of the present invention.

FIG. 7 is a cross-sectional view of the microphone housing and structure of the preferred embodiment of the present invention. Microphone system 10 includes a directional microphone element 28 partially enclosed in a housing structure 26. Microphone 28 is generally a directional microphone structure and can be a condenser microphone or the like, as are known in the art. Of course, a condenser microphone is just an example of the microphone structure 28 that can be employed by the present invention, and all equivalents thereof are deemed covered by the scope of the present invention. Housing structure 26 is, of course, shaped to accommodate the microphone element 28 and can be made of plastic, metal, stainless steel, etc. Preferably, housing structure 26 is made of plastic for reduced cost and weight considerations. In addition, housing structure 26 can be appropriately modified in accordance with the particular dimensional requirements of microphone element 28, and all such modifications are deemed included within the present invention, in accordance with the structural description provided below.

Microphone 28 has a diaphragm 16, a perforated backplate electrode 14, a resistive delay path 28 and a perforated rear plate 22. Of course, as mentioned above, this is only an exemplary microphone structure, and other microphone structures known in the art can be used instead. Microphone 28 is positioned in the housing structure 26 so that housing structure 26 surrounds the side of the microphone element, with the front portion thereof exposed. Resistive delay path 28 can be a foam material, e.g., a polyurethane foam, or a dense fiber material. or other material known in the art sufficient to exhibit moderate sound absorbing properties. In the front of the diaphragm 16 is a sonically transparent structure 32 provided so that the front (i.e., the exposed portion) of the microphone element 28 is highly receptive to sound. Sonically transparent structure 32 can be, for example, a thin layer of felt or a fine stainless steel mesh screen (or a combination thereof) or other structures known in the art that are transparent to sound passing therethrough.

In accordance with a preferred embodiment of the present invention, behind the perforated rear plate 22, a tapered structure 12 is provided. Preferably, tapered structure 12 has a generally conic shape being smaller near the microphone element and expanding outwardly from the back of the microphone element 28 until meeting the housing structure 26. The tapered structure 12 leaves an area of open air 34 between the sides of the tapered structure and the housing structure 26. The tapered structure 12 is made of solid material, such as plastic or a resistive material, such as felt. A key feature of the present invention, tapered structure 12 has a generally conic shape to provide a gradually increasing acoustical impedance as a result of the gradually decreasing cross-sectional area of the tapered structure 12. Also, the generally conic shape of the tapered structure 12 preferentially collects signal components from behind the microphone and ducts them into the rear ports of the microphone element; and guides reflected, unwanted signals outwardly and away from the rear portion of the microphone element 28. Tapered structure 12 is provided in accordance with the present invention to provide a more directional rear port microphone system, improve the front frequency response of the microphone, and to provide more effective rear port signal cancellation, thereby providing a better front-to-back signal ratio than provided in the prior art.

The ideal condition for rear rejection is achieved when signal coming from the rear reaches the front side of the diaphragm via front port with the same amplitude and the same phase as it reaches the rear side of the diaphragm via rear port. In the situation like this small differences in amplitude and/or phase of the canceling signals will result in significant differences in front-to-back ratio and will affect the whole directivity pattern of the microphone. This is why it is extremely important to pay a lot of attention to the details of the rear port design and have as much control over it as possible. Differences in the order of 0.5–1 dB in rear port transmission make differences in order of tens of dB in front-to-back ratio. This is the part of microphone design which was not seriously considered in most of the designs of the prior art.

In addition, around the tapered portion of the tapered structure 12, the housing structure is provided with a plurality of radially placed slots or openings 14 fully or partially covered by a resistive felt and protective outer screen 24. A primary function of these radially disposed slots or openings is to allow sound to reach the rear ports of the microphone element as well as to allow reflected signals (i.e., signals reflecting in and around the tapered structure 12 and the air 34) to exit the area of the rear portion of the microphone. Also, the resistive felt 24 provides an additional delay path to sound coming to the rear ports of the microphone element 28.

Figure 8:
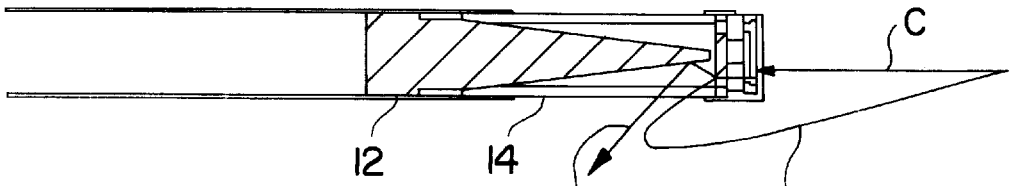
FIG. 8 depicts sound propagation around the housing and structure of FIG. 7.
Figure 9:
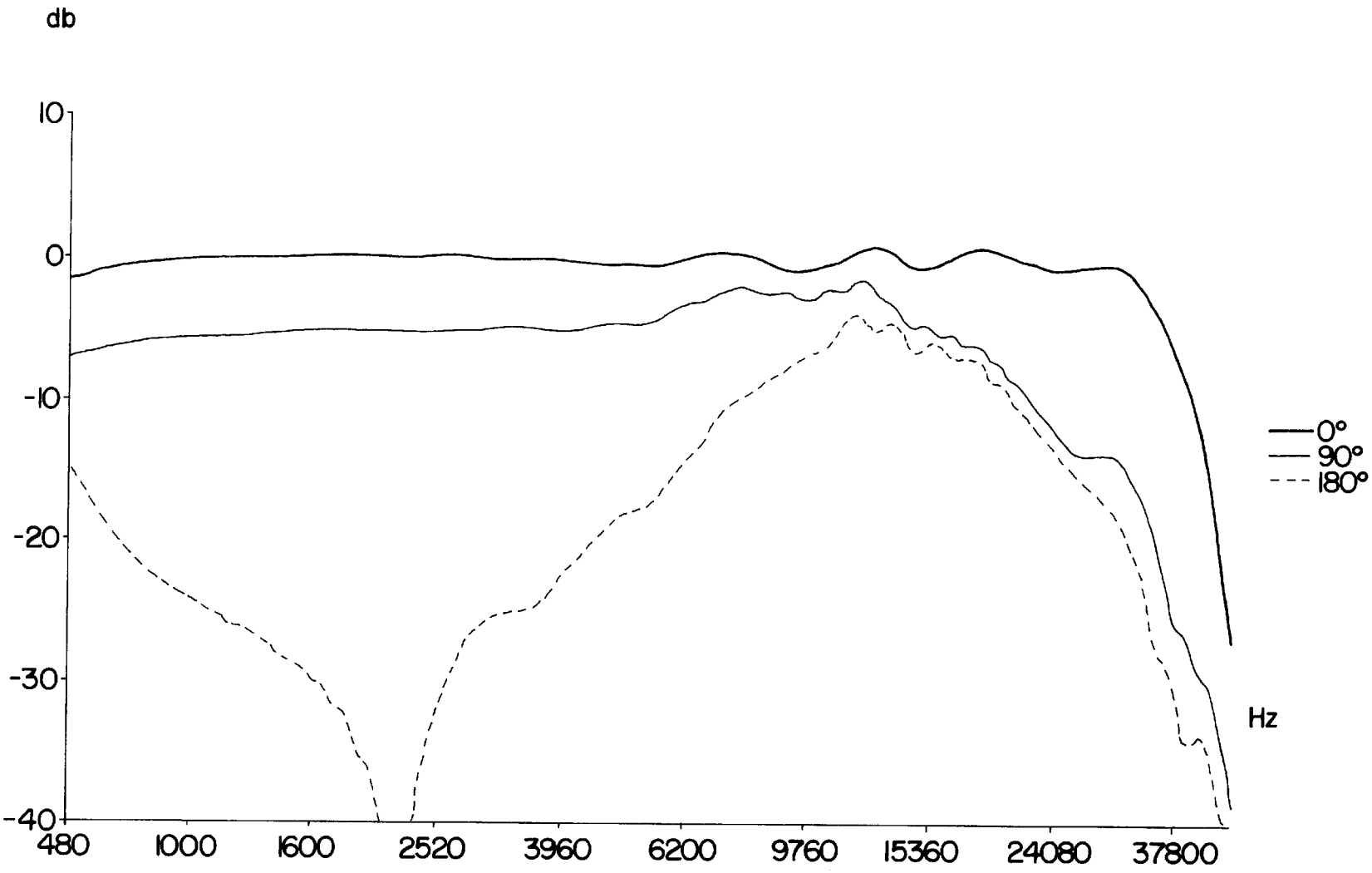
FIG. 9 depicts the frequency response of the preferred embodiment of FIG. 7.
Figure 10:
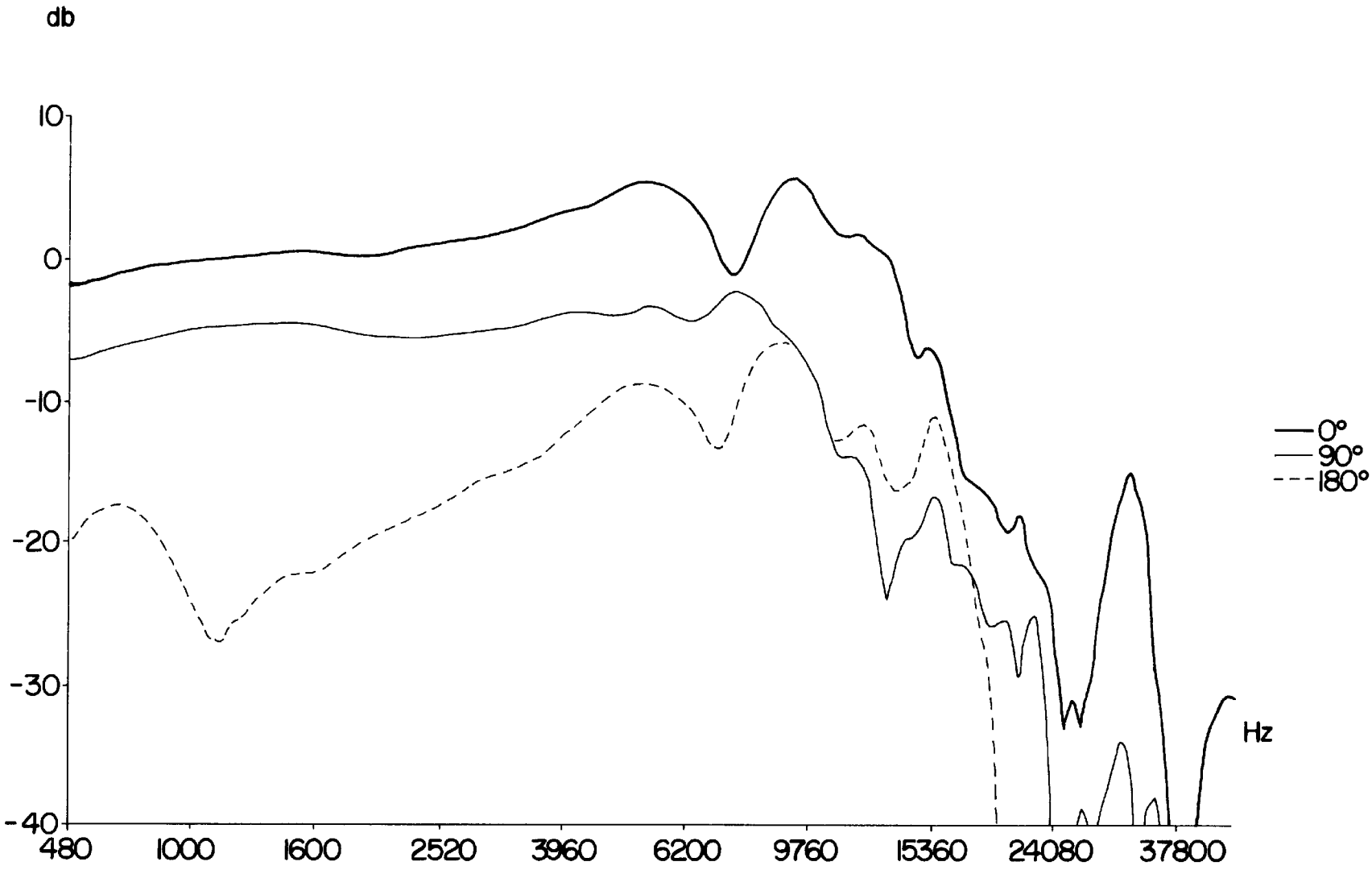
FIG. 10 depicts the frequency response of the directional microphone of the prior art.

FIG. 8 depicts sound propagation in accordance with the housing 26 and tapered structure 12 of the present invention. As shown in FIG. 8, sound C coming from the front direction (i.e., 0° incident sound) reaches the microphone element 28 virtually unimpeded. However, sound D entering behind the front of the microphone is going through the resistive delay path 28 of the microphone element 28 onto the tapered structure 12. The reflected sound D' is then reflected away from the rear portion of the microphone element 28 to be absorbed or leave the system through the radially disposed slots or openings 14. Also, sound entering from the rear (D) into the housing structure is first delayed by the resistive material 24 covering the slots 14. The overall effect of the tapered structure 12 and the housing structure (i.e., the radially disposed slots 14 and the resistive outer material 24 covering the slots) is graphically noted in the gain/frequency plot of FIG. 10. As a result of the aforementioned structure, the frequency response of the present invention remains smooth at 0° incidence and 90° incidence. Also note the highly attenuated 180° incidence response.

Thus, it is evident that there has been provided a microphone housing and structure that fully satisfy both the aims and objectives hereinbefore set forth. It will be appreciated that although the preferred embodiment has been presented, many modifications, alternatives and equivalents are possible. For example, in another embodiment, tapered structure 12 can be made of other material, i.e. brass or cintered plastic (actually any material with high internal loss). In addition, the radially disposed slots or openings 14 are chosen in accordance to the type of microphone housed in the housing structure 26.

Accordingly, the present invention is intended to cover all such alternatives, modifications, and equivalents as may be included within the spirit and broad scope of the invention as defined only by the hereafter appended claims.

What is claimed is:

1. A directional microphone system, comprising:

a housing structure substantially surrounding a microphone element, and a tapered structure contained within said housing and coupled to a rear portion of said microphone element, said tapered structure acting as a directional coupler to enhance rear port directional sensitivity and also reflecting unwanted sound signals away from said rear portion of said microphone element; wherein said tapered structure having a generally conical shape expanding away from said rear portion of said microphone element defining an air space behind said rear portion of said microphone element between said housing and said cone-shaped tapered structure.

2. A microphone system as claimed in claim 1, wherein said tapered element being formed of sound-reflecting or absorbing material.

3. A microphone system as claimed in claim 1, wherein said housing structure further comprising a plurality of radially disposed slots or openings behind said rear portion of said microphone element said slots being at least as long as circumference of the microphone housing or longer.

4. A microphone system as claimed in claim 3, further comprising a sound resistive material fully or partially disposed over said openings.

5. A microphone system as claimed in claim 1, further comprising a sound-absorbing material disposed over a front portion of said microphone.

6. A microphone system as claimed in claim 1, wherein said housing structure is made of plastic or metal.

7. A microphone system as claimed in claim 1, wherein said microphone element comprises a directional microphone element having directional sound characteristics.

8. A directional microphone housing system, comprising:

a housing structure substantially surrounding a microphone element, said housing structure having a plurality of radially disposed slots adjacent a rear portion of said microphone element, said slots being at least as long as circumference of the microphone housing or longer; and a tapered structure contained within said housing and coupled to said rear portion of said microphone element, said tapered structure acting as a directional coupler to enhance rear port directional sensitivity and also reflecting unwanted sound signals away from said rear portion of said microphone element; wherein said tapered structure having a generally conical shape expanding away from said rear portion of said microphone element defining an air space behind said rear portion of said microphone element between said housing and said cone-shaped tapered structure.

9. A housing system as claimed in claim 8, wherein said radially disposed slots having a sound resistive covering thereon.

10. A housing system as claimed in claim 8, wherein said tapered structure has gradually increasing acoustical impedance.

11. A housing system as claimed in claim 8, wherein said tapered structure is formed of sound resistive material such as felt; or sound reflective material such as plastic.

12. A housing system for a direction microphone, comprising:

a housing structure substantially surrounding a microphone element, said housing structure having a plurality of radially disposed slots adjacent a rear portion of said microphone element, said slots being at least as long as circumference of the microphone housing or longer; said plurality of radially disposed slots having a sound resistive covering thereon; and a tapered structure contained within said housing and coupled to said rear portion of said microphone element, said tapered structure having a conic shape expanding away from said rear portion of said microphone element and defining an air space behind said rear portion of said microphone element between said housing and said cone-shaped tapered structure; said housing structure and said tapered structure cooperating to act as a directional coupler to enhance rear port directional sensitivity and also to reflect and/or absorb unwanted reflecting sound signals from said rear portion of said microphone element.

* * * * *